US007651376B2

(12) United States Patent
Schreier

(10) Patent No.: US 7,651,376 B2
(45) Date of Patent: Jan. 26, 2010

(54) CONTACT ELEMENT FOR SHIELDED CONNECTORS

(75) Inventor: Stephan Schreier, Rahden (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 11/775,765

(22) Filed: Jul. 10, 2007

(65) Prior Publication Data

US 2008/0032556 A1 Feb. 7, 2008

(30) Foreign Application Priority Data

Aug. 2, 2006 (DE) ..... 20 2006 011 850 U

(51) Int. Cl.
*H01R 9/03* (2006.01)

(52) U.S. Cl. ..... 439/610

(58) Field of Classification Search ..... 439/610, 439/578, 585

See application file for complete search history.

(56) References Cited

U.S. PATENT DOCUMENTS 3,181,105 A * 4/1965 Roach et al. ..... 439/275
4,178,056 A * 12/1979 Lee ..... 439/472
4,213,667 A * 7/1980 Wittes ..... 439/469
4,963,104 A * 10/1990 Dickie ..... 439/460
4,964,815 A * 10/1990 Kawai et al. ..... 439/610
5,383,796 A * 1/1995 Bowen et al. ..... 439/469
6,641,429 B1 * 11/2003 Wu ..... 439/465

FOREIGN PATENT DOCUMENTS

| | | |
|---|---|---|
| DE | 90 15 056.2 | 2/1991 |
| DE | 41 37 355 | 5/1993 |
| EP | 0772259 | 5/1997 |

* cited by examiner

*Primary Examiner*—Phuong K Dinh
(74) *Attorney, Agent, or Firm*—Hayes Soloway P.C.

(57) ABSTRACT

To connect the shielding of an electric cable to a metallic connector, an electrically non-conductive cable guide part that features a wall segment of an electrically conductive material that needs to be laterally opened sectionally is provided. In this case, the shielding of the electric cable lying in the interior is connected to a corresponding mating connector by means of the wall segment and an electrically conductive connector sleeve surrounding the connector.

15 Claims, 5 Drawing Sheets

CONTACT ELEMENT FOR SHIELDED CONNECTORS

BACKGROUND OF THE INVENTION

1. Field of the Invention

The invention pertains to a contact element for connecting the shielding of an electric cable to a connector.

A contact element of this type is required for easily contacting the shielding of a shielded cable with a connector to be shielded against electric interference signals.

2. Description of the Related Art

The braided shielding of an electric cable or conductor can be contacted with a connector housing to be shielded with a variety of known connectors.

Different mechanical devices have been proposed in this respect, wherein DE 41 37 355 C2 discloses an electric connector for shielded cables, in which an electrically conductive elastomer part is provided for the electric connection between the shielding of the cable and the housing.

DE 90 15 056 U1 discloses a circular electric connector that is impervious to water and high frequencies, wherein the shielding of the cable lies on an electrically conductive shielding sleeve and the shielding is pressed against the shielding sleeve by means of a surrounding ring seal and a clamping basket when a screw connection with a threaded sleeve is produced.

In this case, it is disadvantageous that an additional component is required in most instances in order to realize the electric contacting, wherein this additional component is supplied separately, easily forgotten during the assembly or lost.

SUMMARY OF THE INVENTION

The invention is based on the objective of realizing the contacting for a connector in such a way that the user is able to easily connect the shielding to the connector, wherein the contact element is connected to the connector in a captive fashion.

This objective is attained in that an electrically conductive wall segment to be opened sectionally is provided in a recessed section adjacent to a collar region of a cylindrical, non-conductive cable guide part.

Correspondingly shielded plug-type connections are indispensable for the data transmission of signals that need to be protected against external electromagnetic interferences.

This is the reason why an exchangeable variation of a splicing ring was developed for a connector system with circular connectors that has been produced for quite some time, wherein this variation of a splicing ring makes it possible to easily lay the shielding of an electric cable on such a connector.

For this purpose, a conventional cable guide part that is otherwise known as a "splicing ring" and arranged within a connector sleeve features a wall segment that can be laterally disengaged, wherein the cable guide part is made of an insulating material while the wall segment consists of an electrically conductive material and can be advantageously engaged with the cable guide part.

The wall segment is shaped about semicircularly in accordance with the sleeve-shaped cable guide part and provided with a toggle lever that can be inserted into the interior of the cable guide part and engages therein, but advantageously allows an outward tilting movement. In this case, it is also advantageous that the wall segment that can be disengaged forms a funnel-shaped passage for simplifying the insertion of an electric cable.

After the insertion of the electric conductors into the corresponding conductor channels in the cable guide part, the wall segment is engaged once again and forms a unit that can be inserted into the connector sleeve.

In addition, rounded ribs that point into the center of the cylindrical body of the cable guide part are formed in the region of the collar. In this case, a rib of the electrically non-conductive part of the cable guide part and at least one oppositely arranged bulge are moulded into the electrically conductive wall segment.

The ground signal delivered via the cable shielding is forwarded to the surrounding electrically conductive connector sleeve by means of the electrically conductive bulge formed by the two ribs.

BRIEF DESCRIPTION OF THE DRAWINGS

One embodiment of the invention is illustrated in the figures and described in greater detail below. The figures show.

DETAILED DESCRIPTION OF THE INVENTION

Figure 1:
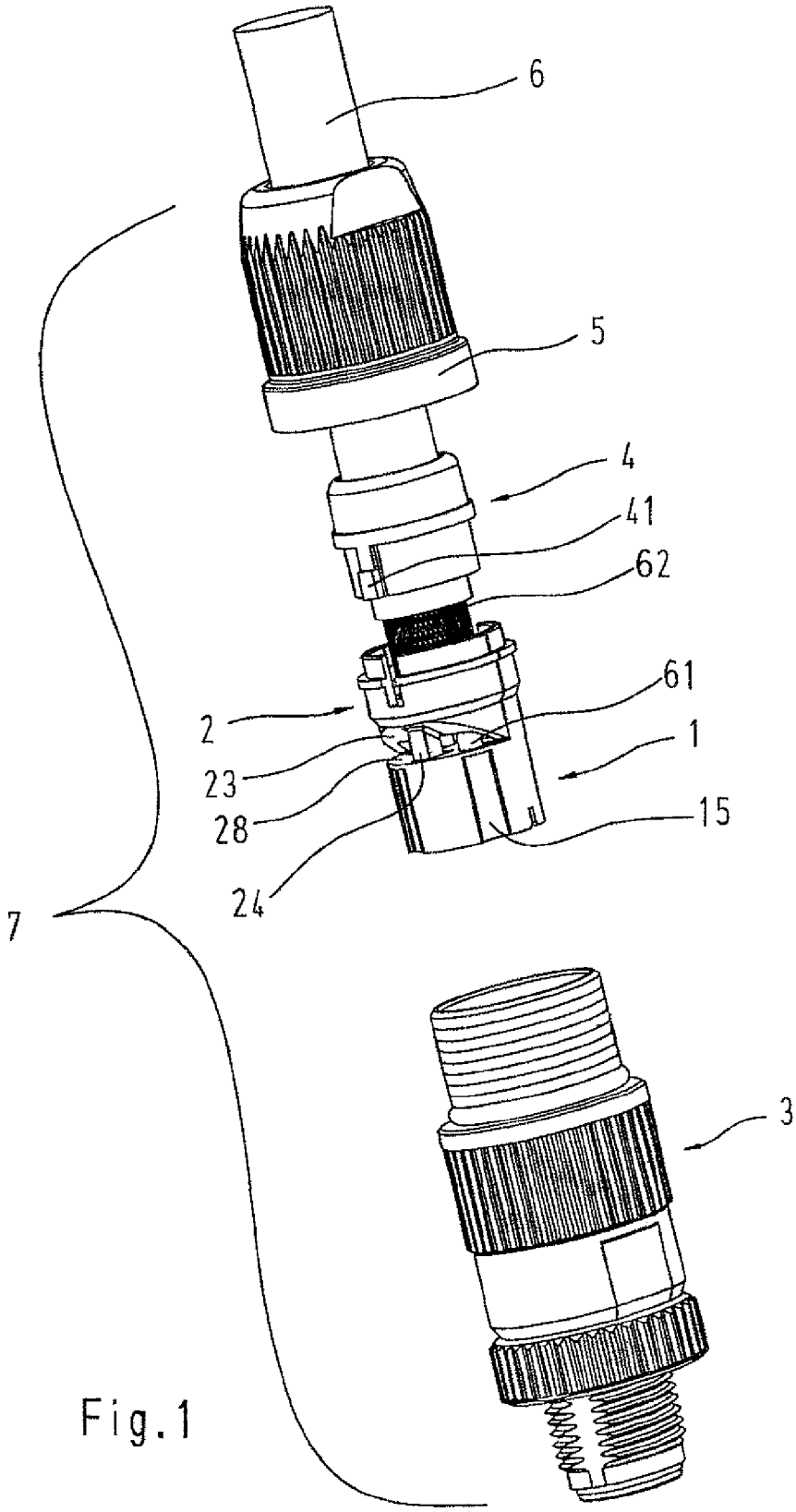
FIG. 1 an exploded perspective representation of a connector.

FIG. 1 shows a connector 7 in the form of a partially exploded representation with an electric cable 6, a coupling ring 5 that is pushed on said cable, a sealing insert 4 and a cable guide part 1 that is also referred to as a splicing ring, as well as a plug contact insert 3, in which not-shown electric contacts are arranged.

The cable guide part 1 features several specially shaped through-openings 13 in its interior, wherein one individual electric conductor contacted by an electric contact needs to be respectively inserted into said through-openings.

A contact element realized in the form of a wall segment 2 is also assigned to the cable guide part 1, wherein said wall segment occupies a recessed semicircle 20A of the cable guide part and can be tilted radially outward about an acutely angled edge 29 within the angular range of the recessed section of the cable guide part.

A zone 28 with a wedge angle of 30° formed by the acutely angled edge 29 is required in order to open the wall segment, wherein the wall segment is rotatably supported by means of a toggle lever 24 inserted into the cable guide part 1.

Figure 2:
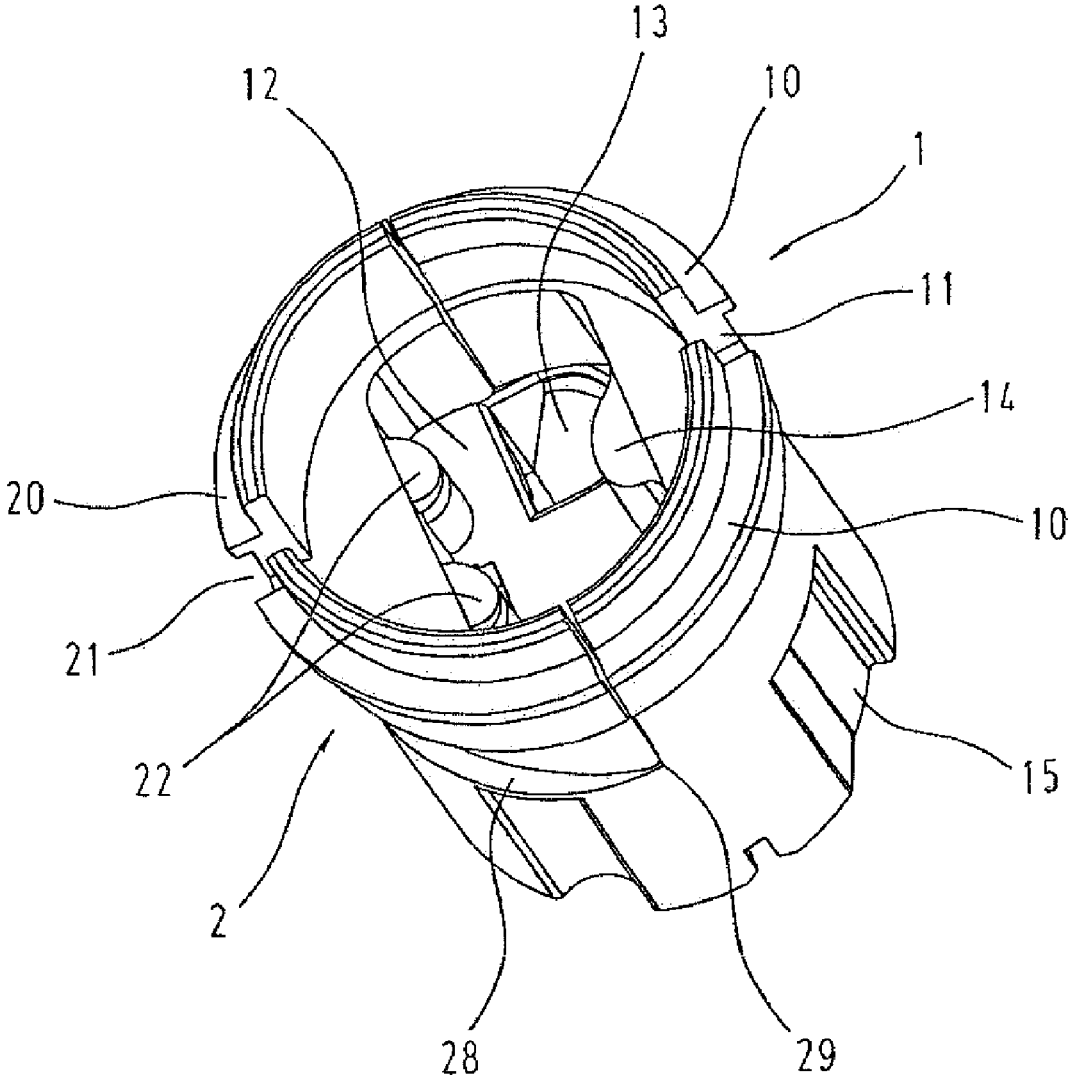
FIG. 2 an individual cable guide part of the connector.

FIG. 2 shows the connecting element 1 in the form of a perspective representation, in which part of the interior structure is visible.

The connecting element 1 as a whole has the shape of a round body and features a collar in the upper part, wherein one collar half 10 is formed by the connecting element 1 while the second collar half 20 is formed by the metallic wall segment 2.

In this case, the wall segment is shaped identical to the collar of the connecting element in the region of the collar 20 such that a circular shape is realized that features two locking grooves 11, 21, into which one respective snap-in projection 41 of the sealing insert 4 to be attached on the collar can be inserted.

In the interior of the round body, at least one rounded rib 14, 22 that points into the interior is provided on each of the two body halves, wherein two ribs 22 are provided in this case and the opposite rib 14 is arranged symmetric thereto.

The interior structure as a whole forms an about rectangular cable opening 12 with a few through-openings 13.

Figure 3:
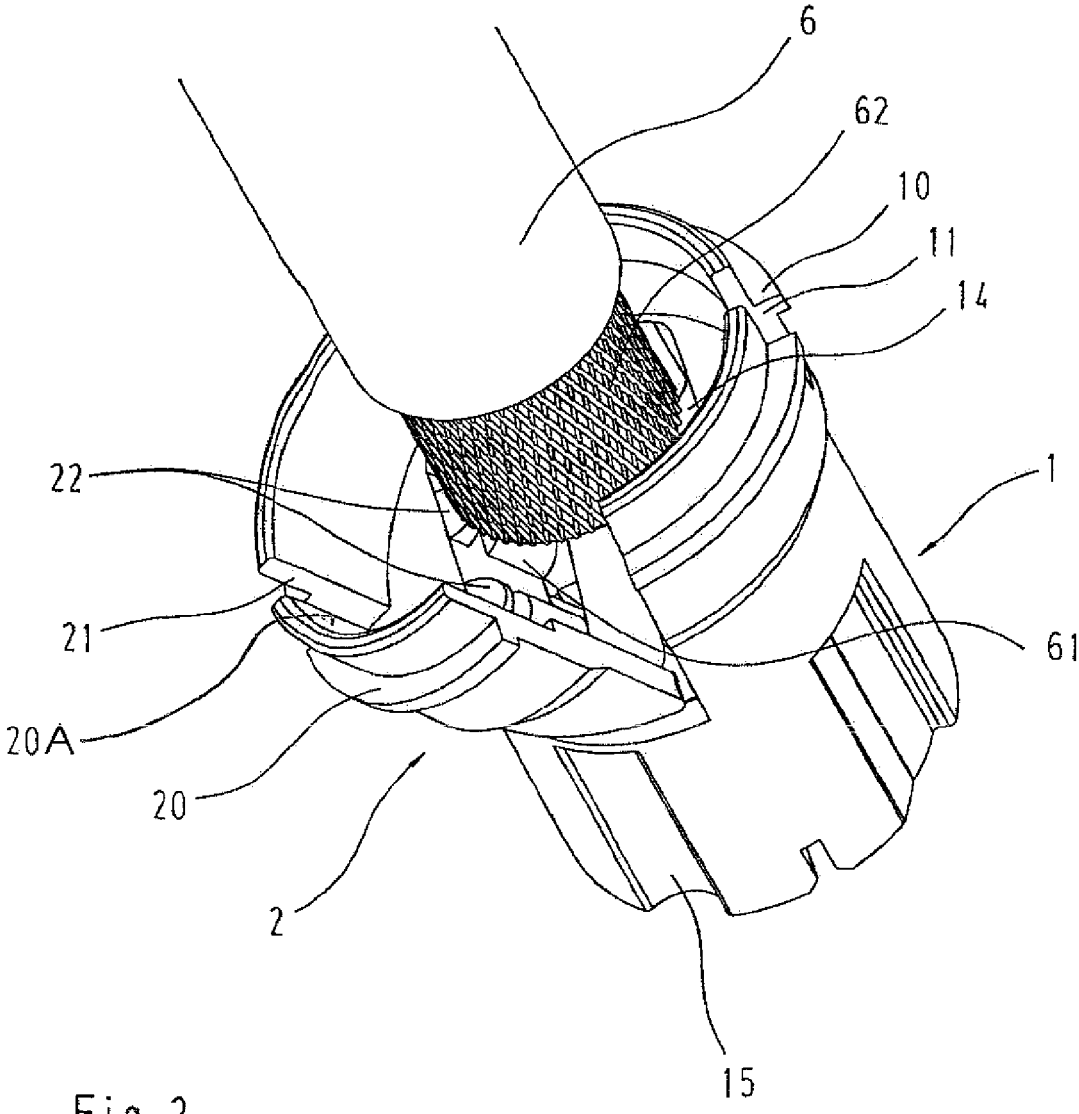
FIG. 3 the cable guide part with an indicated electric cable.

In this case, one individual electric conductor 61 needs to be respectively inserted into the two through-openings 13 provided within the cable opening 12, wherein the stripped cable shielding is inserted into the cable opening 12 and fixed with the aid of the two ribs 14, 22 as shown in FIG. 3, in which the wall segment is still tilted into its open position.

Figure 4:
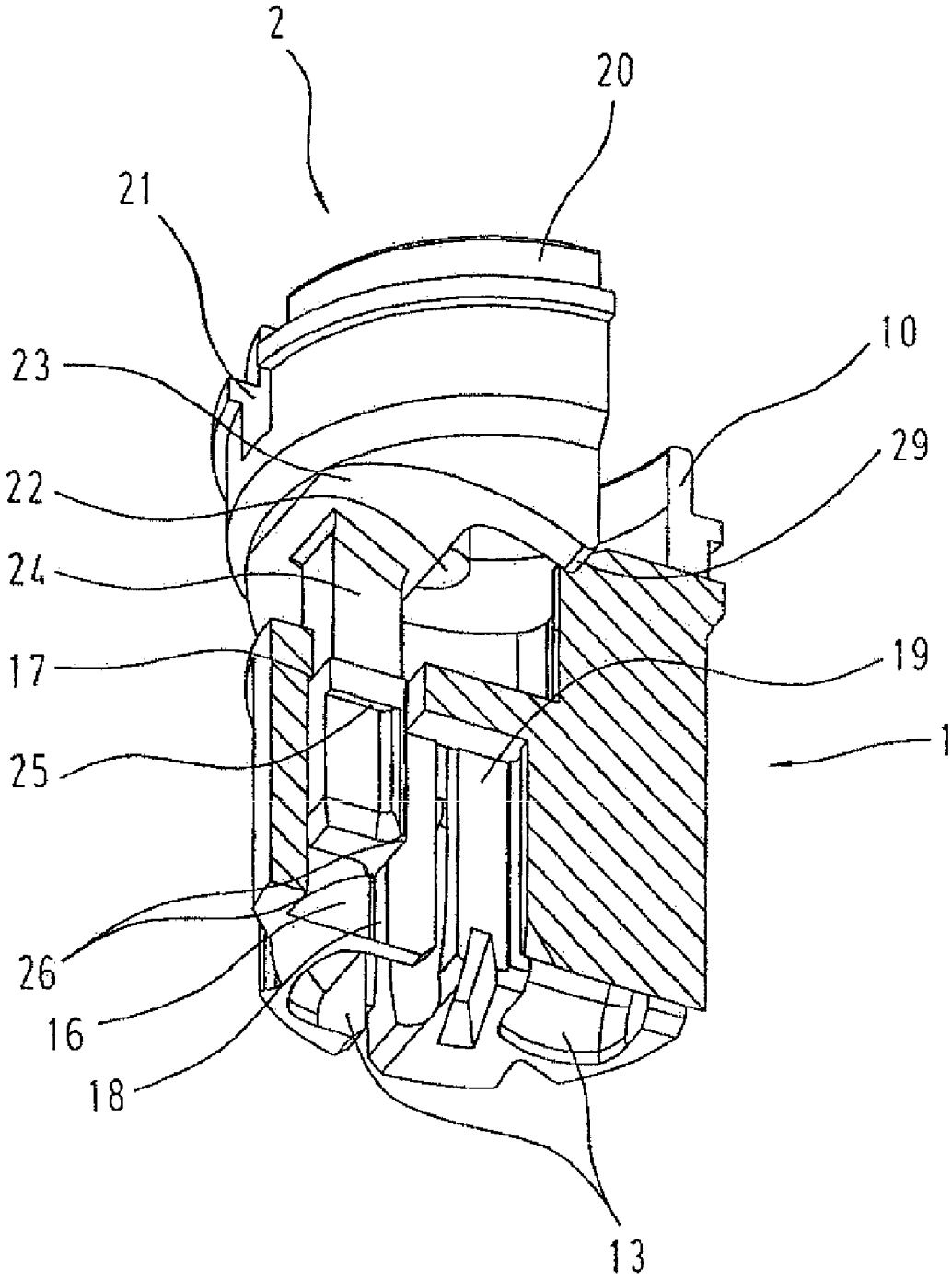
FIG. 4 a partially sectioned cable guide part with an engaged wall segment, and FIG. 5 the partially sectioned cable guide part with the tilted wall segment.

FIG. 4 shows a perspective representation of the cable guide part 1, in which the wall segment 2 is illustrated in the closed position, wherein the cable guide part is longitudinally sectioned about centrally such that the function of the toggle lever 24 can be elucidated.

The cable guide part 1 features a continuous rectangular opening 16, into which the wall segment 2 within the toggle lever 24 is inserted. In order to guide the toggle lever in the vertical direction, two snap-in edges 26 formed on the toggle lever 24 slide along two snap-in edges 18 in the rectangular opening 16.

Once correspondingly inserted, the toggle lever engages with a step 25 behind a snap-in shoulder 17 in the rectangular opening 16.

Figure 5:
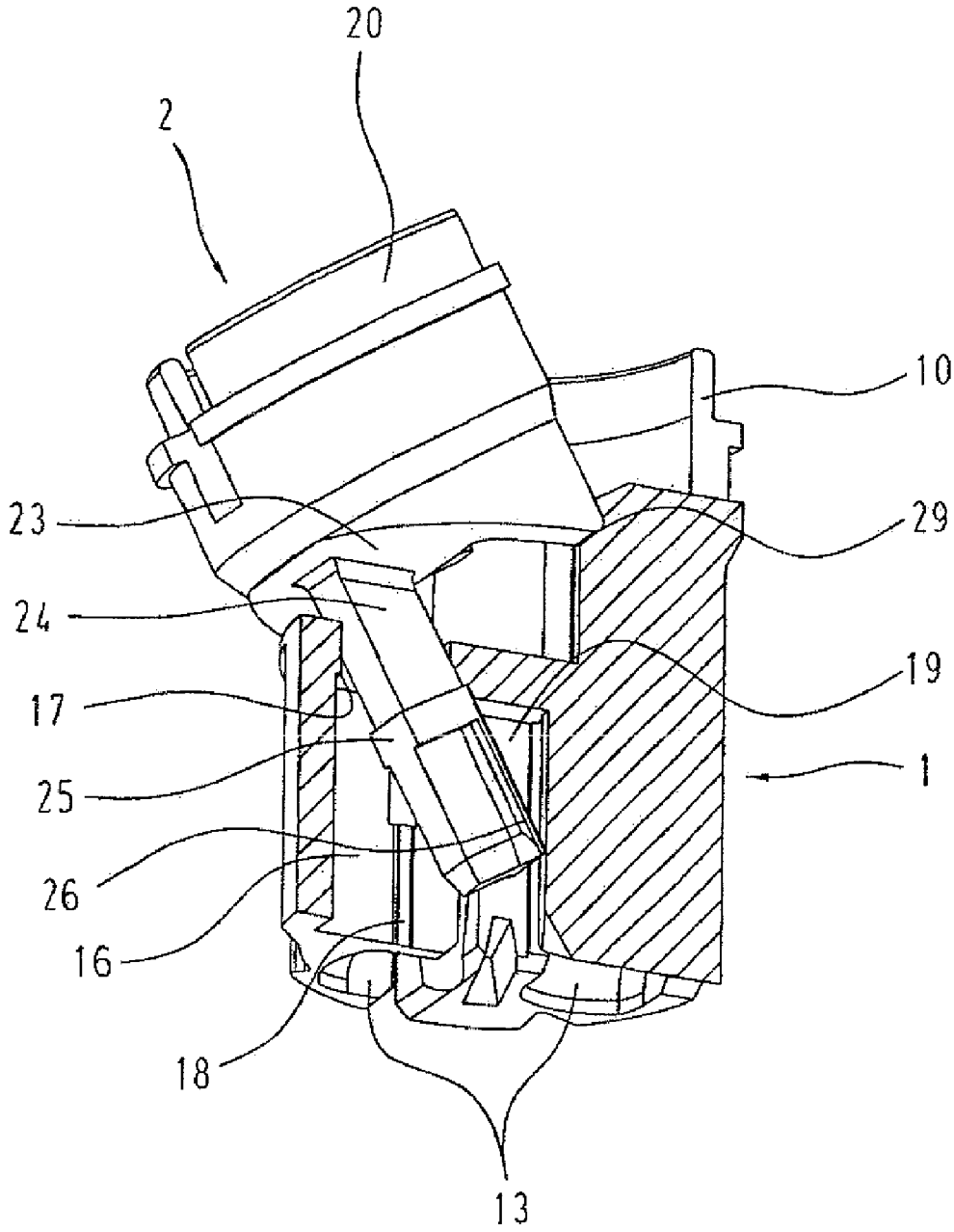

When the close wall segment 2 is pulled or pressed radially outward as shown in FIG. 5, the toggle lever 24 situated in the rectangular opening 16 is tilted about the acutely angled edge 29 within the free space 19 in the cable guide part 1.

During this process, the snap-edge 26 on the toggle lever jumps over the snap-in edge 18 in the rectangular opening 16, wherein the wall segment 2 is freely movable in any position between 0° and 30°, but still held in the cable guide part.

The electric cable 6 can be easily installed in this opened state of the wall segment 2.

During the assembly of the electric cable and the connector, the coupling ring 5 and subsequently the sealing insert 4 are pushed on the cable end of the electric cable 6. The wires of the individual electric conductors 61 and part of the shielding 62 are then exposed.

Subsequently, the individual electric conductors 61 are inserted into the corresponding through-openings 13 in the cable guide part 1 until the shielding is positioned between the ribs 14 and 22 in the region of the cable opening 12.

The wall segment 2 is then closed and the sealing insert 4 is joined with the cable guide part 1, wherein one of the oppositely arranged connecting notches respectively engages into the locking groove 11, 21 such that the cable guide part and the sealing insert form one unit.

After removing the conductor ends that protrude from the through-openings 13 of the cable guide part, this interconnected unit is inserted into the plug contact insert 3 and secured by means of the coupling ring 5. During this process, the individual electric conductors are pressed into corresponding insulation displacement contacts within the plug contact insert and the electric connection between the cable shielding on the metallic plug contact insert 3 and a mating connector is produced by means of the metallic wall segment 2 and the coupling ring 5.

What is claimed is:

1. A contact element for connecting the shielding of an electric cable to a connector, comprising:

a nonconductive cylindrical cable guide part having a collar and a sectionally openable electrically conductive segment disposed in a recessed semicircular section of the collar for electrically connecting to the shielding of the electric cable.

2. The contact element according to claim 1, further comprising a toggle lever formed on the electrically conductive segment and insertable into a corresponding opening in the cable guide part, wherein the toggle lever rotatably supports the electrically conductive segment such that the electrically conductive segment can be outwardly opened by being radially tilted about an imaginary axis of rotation.

3. The contact element according to claim 1, wherein a bevel is provided on the electrically conductive segment on the surface bordering the cable guide part.

4. The contact element according to claim 1, wherein the cable guide part features ribs that point into the interior in order to fix and contact the shielding of the electric cable, wherein one rib is formed on the cable guide part and at least one other rib is formed on the electrically conductive segment.

5. The contact element according to claim 1, wherein the electrically conductive segment comprises about half the collar.

6. The contact element according to claim 3, wherein the bevel allows the electrically conductive segment to be outwardly opened about 30 degrees.

7. The contact element according to claim 1, wherein the electrically conductive segment and collar of the cable guide part are provided with locking grooves oppositely arranged.

8. The contact element according to claim 1, wherein the interior of the cable guide part comprises a plurality of through-openings, wherein individual electric conductors of the electric cable may be respectively inserted.

9. A contact element for connecting the shielding of an electric cable to a connector, comprising an electrically conductive segment of a collar of a cylindrical, non-conductive cable guide part is provided in a recessed section and is openable sectionally, a toggle lever formed on a wall of the electrically conductive segment and insertable into a corresponding opening in the cable guide part, wherein the toggle lever rotatably supports the electrically conductive segment such that the electrically conductive segment can be outwardly opened by being radially tilted about an imaginary axis of rotation, wherein the toggle lever of the wall of the electrically conductive segment is lockable by a snap-in shoulder formed in the opening of the cable guide part.

10. The contact element according to claim 9, wherein a bevel is provided on the electrically conductive segment on the surface bordering the cable guide part.

11. The contact element according to claim 9, wherein the cable guide part features ribs that point into the interior in order to fix and contact the shielding of the electric cable, wherein one rib is formed on the cable guide part and at least one other rib is formed on the electrically conductive segment.

12. The contact element according to claim 9, wherein the electrically conductive segment comprises about half the collar.

13. The contact element according to claim 10, wherein the bevel allows the electrically conductive segment to be outwardly opened about 30 degrees.

14. The contact element according to claim 9, wherein the electrically conductive segment and collar of the cable guide part are provided with locking grooves oppositely arranged.

15. The contact element according to claim 9, wherein the interior of the cable guide part comprises a plurality of through-openings, wherein individual electric conductors of the electric cable may be respectively inserted.

* * * * *